United States Patent [19]

Büll et al.

[11] 4,380,410

[45] Apr. 19, 1983

[54] MINE-ROOF SUPPORT

[75] Inventors: Hans Büll; Gerhard Ewich, both of Wuppertal; Günther Kuschke, Castrop-Rauxel; Alfred Maykemper; Josef Welzel, both of Wuppertal, all of Fed. Rep. of Germany

[73] Assignee: Hermann Hemscheidt Maschinenfabrik GmbH & Co., Wuppertal, Fed. Rep. of Germany

[21] Appl. No.: 243,432

[22] Filed: Mar. 13, 1981

[30] Foreign Application Priority Data

Mar. 15, 1980 [DE] Fed. Rep. of Germany ..... 3010082
Jul. 26, 1980 [DE] Fed. Rep. of Germany ..... 3028394

[51] Int. Cl.[3] ..... E21D 23/04
[52] U.S. Cl. ..... 405/299; 405/297
[58] Field of Search ..... 405/291, 299, 300, 301, 405/297; 299/33, 31

[56] References Cited

U.S. PATENT DOCUMENTS 3,258,108 6/1966 Cowlishaw ..... 405/299 X
3,364,683 1/1968 Farr ..... 405/299
3,448,584 6/1969 Rieschel ..... 405/299
3,883,179 5/1975 Floter et al. ..... 405/291 X

FOREIGN PATENT DOCUMENTS 1170246 11/1969 United Kingdom ..... 405/299

*Primary Examiner*—David H. Corbin
*Attorney, Agent, or Firm*—Berman, Aisenberg & Platt

[57] ABSTRACT

A self-advancing mine roof support has a beam-like abutment adapted to be disposed generally adjacent and parallel to a work face. Three roof support elements are spaced apart along the abutment and are pivoted to the abutment. The abutment may be angled relative to the direction of advance by arranging the three support elements in staggered formation. A beam of the central support element is pivoted to the abutment. The two outer roof support elements are connected to the abutment by a linkage, e.g., guide arms, which allows the abutment to pivot about the beam of the central element without changing the distance between the three elements as measured at right angles to the direction of advance.

7 Claims, 3 Drawing Figures

MINE-ROOF SUPPORT

This invention relates to a self-advancing mine-roof support for use in longwall mining comprising an abutment adapted to be disposed generally adjacent to and generally parallel to a work face and at least three roof-support elements spaced apart along said abutment and connected to the abutment by means allowing pivoting of the support elements with respect to the abutment whereby the support elements may be disposed in staggered formation (as opposed to line abreast formation) thereby causing the abutment to slant relative to the direction of advance, said roof-support units each comprising a floor runner and double-acting drive means for effecting movement between the floor runner and the abutment for advance of the roof support.

A roof support having the features described above is disclosed in German Auslegeschrift No. 12 05 036. In this support the drive devices of all three roof support elements are pivoted directly to the abutment. This means that, when the degree of stagger of the roof support elements is changed to meet different working conditions, the "between centres" distance (measured at right angles to the direction of advance) between the three elements is changed.

However, when working a longwall coal seam which dips steeply, it is essential if satisfactory operation is to be achieved for it to be possible to change the degree of stagger without there being any change in the "between centres" distance.

British Pat. No. 1,492,586 discloses a more complicated device than that of German Specification No. 1,205,036, but this more complicated device also produces a change in the "between centres" distance when the degree of stagger is changed.

In German Patent Application No. 2,942,943 it has been proposed to construct the said abutment to be telescopic, which is one solution to the problem described above, since it allows the length of the abutment to increase as the degree of stagger increases, so that the "between centres" distance can remain unchanged.

However, the use of a telescopic abutment has certain disadvantages, and it is therefore an aim of the present invention to provide a different and more practical solution to the problem described above.

With this aim in view, the invention is directed to a self-advancing mine-roof support having the features set out in the opening paragraph, in which:

(a) the drive means of a central one of said roof-support elements includes a beam which is pivotally connected to the abutment for movement about a pivot point, said beam being generally aligned with the direction of advance;

(b) adjustment means are provided for adjusting to a limited extent the angle of the beam with respect to its associated floor runner whereby the direction of advance is adjustable; and (c) the drive means of the outer ones of the said three roof-support elements is connected to the abutment indirectly by means of a linkage which allows the degree of stagger of the three roof-support elements to be changed without changing "between centres" distance between the roof-support elements.

In use of the roof-support according to the invention, the correct alignment of the direction of advance is controlled by the position of the beam of the central roof support element, whereas the linkage between the outer support elements and the abutment permits the abutment to pivot around the said pivot point without generating any force which would tend to change the said "between centres" distance of the support elements.

Two examples of roof supports according to the invention are shown in the accompanying drawings, in which.

Figure 1:
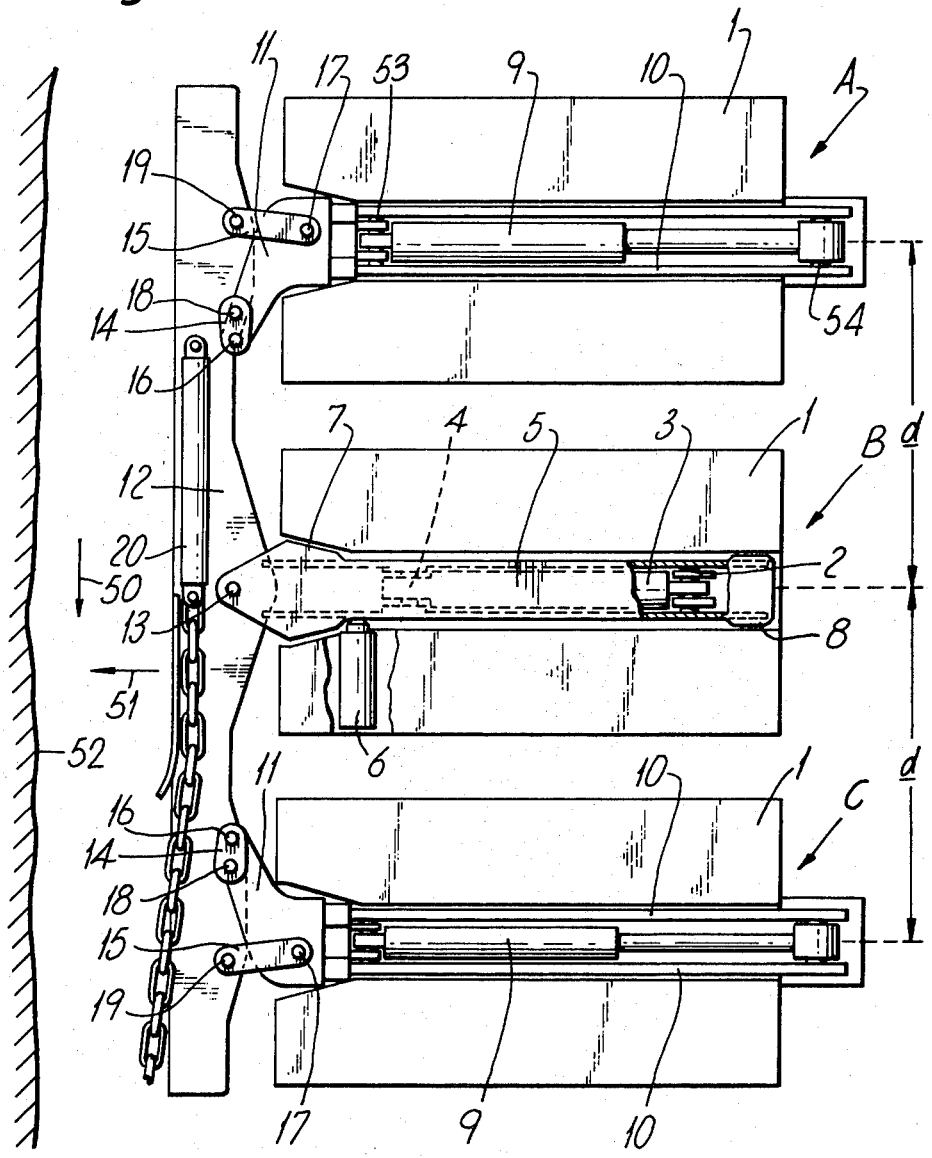
FIG. 1 is a plan view of one form of mine-roof support in which three roof support elements are disposed in line-abreast formation.
Figure 2:
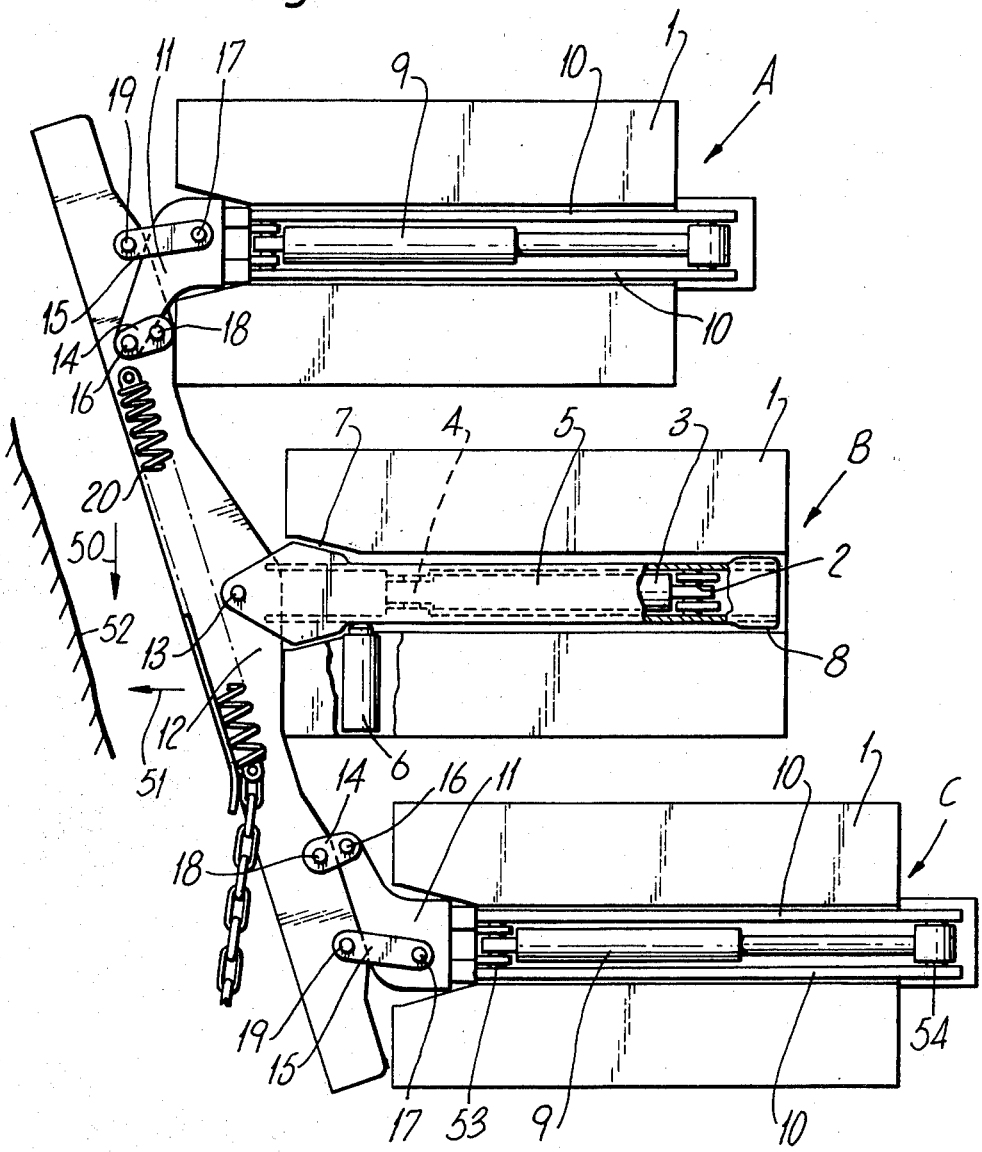
FIG. 2 shows the support of FIG. 1 with the three roof support elements disposed in staggered formation.

The self-advancing mine-roof support shown in FIGS. 1 and 2 comprises three support elements A, B and C disposed side by side. These elements can be of the "frame" or "shield" type, according to choice. Each element A, B and C includes floor runners 1 and drive means mounted on the runners.

The purpose of the drive means is to advance a beam-like abutment 12 towards a workface, and to then draw the rest of the support up towards the abutment. The direction of advance, i.e. the direction in which the support elements A,B,C are moved forward, is indicated by the arrow 51 in FIGS. 1 and 2. It is usual to advance the support elements A, B, and C, in sequence, in such a way that before and after they have been advanced they lie line abreast at right angles to the direction of advance, so that the work-face will be also at a right angle to the direction of advance as shown at 52 in FIG. 1.

However, in certain geological conditions it is desirable to stagger the support elements A, B and C as shown in FIG. 2 so that, for example, after all of the elements have been drawn up towards the work face, the element B is advanced relative to the element C and the element A is advanced relative to the element B. This will have the effect of disposing the above mentioned abutment 12 at an angle relative to the direction of advance which is other than a right angle. In this case, as shown in FIG. 2, the work face 52 (which will always be generally parallel with the abutment 12) will be slanted relative to the direction of advance. It has been found to be very desirable to stagger the elements A, B and C as shown in FIG. 2 when working a longwall coal seam which dips in the direction indicated by the arrow 50 in FIGS. 1 and 2.

The drive means of the central support element B comprise a double-acting hydraulic cylinder 3 mounted at one end in a bearing 2 on its respective floor runner 1 at a location remote from the workface and connected at its other end to an articulated head 4 which engages a feed or advance beam 5 movable in the direction of advance 51 on runner 1.

The direction of the beam 5 (and thus the direction of advance 51) can be controlled or varied to a limited extent by means of a hydraulic ram 6 which is disposed on a rigid frame part of the element B and acts on the beam 5 in a direction opposite to the direction of dip 50. Thus the ram 6 can be used to compensate for any tendency for the support to move slightly downhill in the direction of the dip each time the support is advanced. It is important to ensure that the floor runner 1 of the central unit B maintains alignment with the beam 5 when the floor runner is drawn up towards the abutment 12. For this purpose, the head of the beam 5 has tapered surfaces 7 which co-operate with tapered surfaces on the floor runner to guide the floor runner when it is advanced. Further guide means are provided on the element B in a region remote from the workface, such guide means comprising guide plates 8 on the beam 5 which abut corresponding guide surfaces (not shown) on the floor runner 1.

The drive means of the two outer support elements A and C are similar to each other. In contrast to the drive means of the central element B, the double-acting drive cylinders 9 of the outer elements A and C are pivotally mounted on their respective floor runners adjacent the leading ends of such runners by pivot pin 53. The cylinders 9 extend from the pivot pins 53 rearwardly to a position at the trailing ends of the support elements A and C and are there pivotally connected at 54 to a drive linkage comprised by two parallel spaced apart rods 10. These rods 10 extend from the pivot connection 54 towards the leading ends of support elements A and C, and the leading ends of the rods 10 are engaged in respective booms 11. The two lateral booms 11 on the outer support elements A and C are in mirror image relationship to one another and each has a spigot-like projection extending inwards towards the central support element B. The drive cylinder 3 of the central support element B differs from the outer drive cylinders 9 in that it is larger and thus has twice the driving force. The support elements A, B and C, which, in the illustrated embodiment, are of the "shield" type, are connected to the abutment 12 by way of the beam 5 and the booms 11.

Whereas the feed beam 5 of the central support element B is directly connected to the abutment 12 by a pivot joint 13, the driving linkages 10 of the outer support element are each connected to the abutment 12 indirectly by respective pairs of guide arms 14, 15 disposed at the same lateral distance from the central support B. One end of each arm 14 is pivotally connected at 18 to the abutment 12, whereas the other end of each arm 14 is pivotally connected to a respective boom 11 at point 16. Similarly, the arms 15 are pivotally connected at 19 to the abutment 12 and at 17 to respective booms 11. The arms 14, 15 of the outer support units are disposed in mirror image relationship as viewed in FIG. 1.

When the abutment 12 pivots around joint 13 on beam 5, i.e. when the support moves from the line-abreast formation of FIG. 1 towards the staggered formation of FIG. 2, the pivot pins 18, 19 on the abutment 12 describe a circular arc around joint 13, while pins 16, 17 on booms 11, irrespective of the angle of abutment 12, always remain at a constant distance from the longitudinal axis of beam 5 in the central support element B, so that the two outer elements A and C can be moved forward parallel to the central element B.

When mounted at an angle as shown in FIG. 2, the abutment 12 also serves as an abutment for retaining cylinders 20 of a component bracing arrangement by means of which a conveyor disposed parallel to abutment 12 is prevented from slipping into the dip.

The main advantage of the arrangement described above is that the elements A, B, and C can be moved from their line-abreast position of FIG. 1 to their staggered position of FIG. 2 without there being any substantial change in the distance 'd' (see FIG. 1) between adjacent elements A, B, and C, irrespective of the degree of stagger. This distance 'd', which may be termed a "between centres" distance, is measured at right angles to the direction of advance.

It will be understood that, in use of the support, the three supports elements will be drawn up towards the abutment 12 in the order "C", "B", "A", with the "downhill" element C moving first.

The reason that the cylinder 3 has twice the power of the cylinders 9 is to prevent the extended beam 5 of the central element B from being pushed back by the lever effect at the ends of the abutment 12 when the outer elements A and C advance.

Although the arrangement described above is a great improvement on previously known devices, it has the disadvantage that, because of play in the connections between the abutment 12 on the one hand, and the beam 5 and booms 11 on the other hand, the support tends to work its way downhill in the direction of the dip. Although the abutment beam 12 may move only a slight amount from the preset intended direction of advance during each advance process, the deviations accumulate as working proceeds and result in gradual movement of the roof support in the direction of dip. Although this movement in the direction of the dip can be prevented by means of the ram 6 which can serve to bias the beam 5 away from the direction of dip, it is difficult to judge the amount by which the ram 6 has to be extended, and so it is necessary frequently to check for any deviations in the intended direction of advance and to re-align the support. Aligning may take as much time as the actual advance, and therefore the roof support should be aligned only when necessary for operating reasons, e.g. a change in the dip angle of the working-face.

Figure 3:
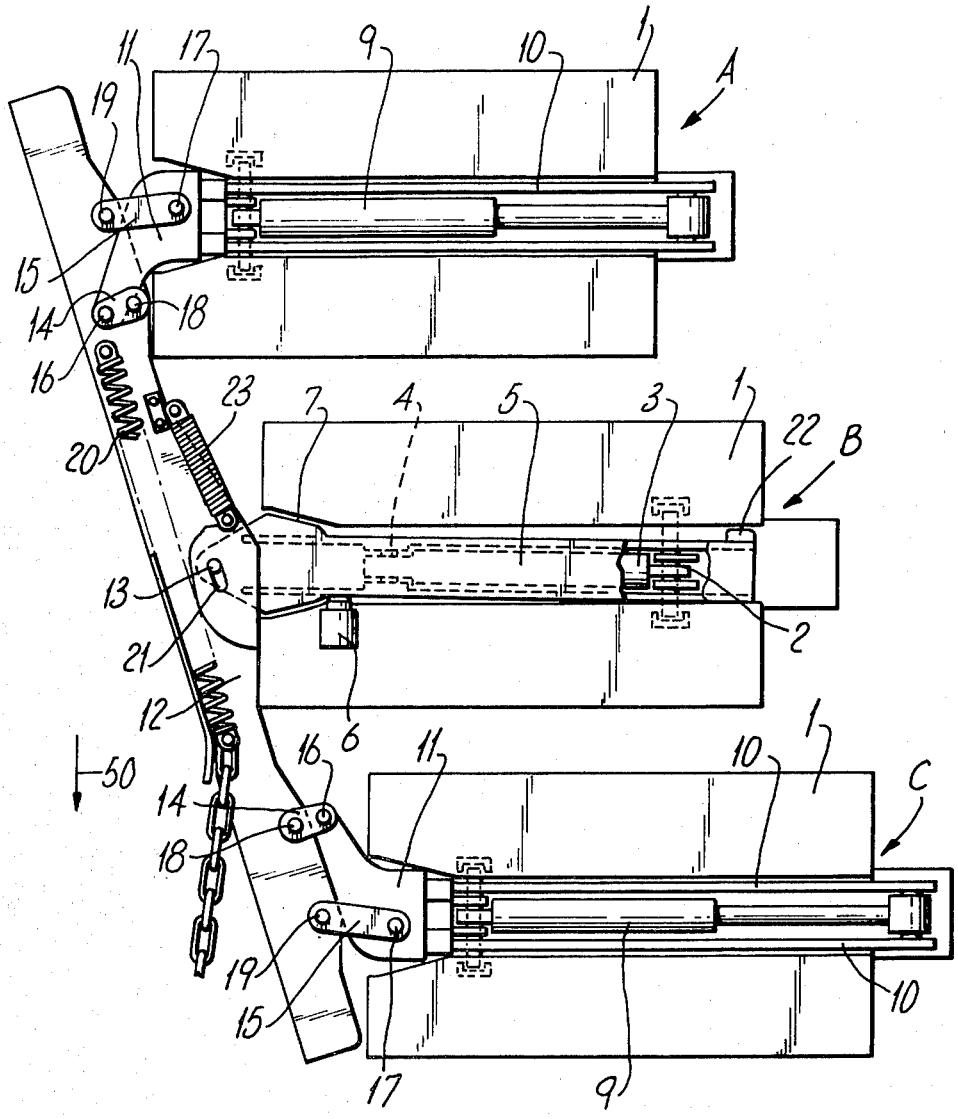
FIG. 3 is a view corresponding to FIG. 2 but showing a second form of roof support.

The support of FIG. 3 has an improved arrangement for maintaining a preset direction of advance, which arrangement can be adjusted according to the angles of dip of the working face. The support of FIG. 3 is similar to the support of FIGS. 1 and 2, although the mounting of the beam 5 of the central support element B is different as now described below.

The head of the beam 5 is not connected to the abutment 12 by a simple pivot, but instead the pivot 13 is movable along a slot 21 which is provided in the abutment 12 and extends longitudinally of the abutment. The head of the beam 5 is also connected to the abutment 12 by a double acting cylinder 23, which cylinder can be adjusted to set the position of the pivot pin 13 at a desired location along the slot 21.

Another distinguishing feature of the embodiment of FIG. 3 is that the rear or trailing end of the beam 5 is provided with a sliding guide or shoe 22 which acts between a side of the beam 5 and the runner 1. This shoe 22 is disposed on the side of the beam remote from the direction of dip, in contrast to the ram cylinder 6 which is disposed between the runner and the beam 5 at a location adjacent the dip-direction. The mounting of the beam 5 allows it to be moved to an oblique position slanted, as shown in FIG. 3, slightly away from the direction of dip. Furthermore, in contrast to the arrangement of FIGS. 1 and 2, in the arrangement of FIG. 3 the cylinder 5 has a longer stroke than the cylinders 9 of the outer support elements A and C. Since the drive cylinder 5 has a longer stroke than the cylinders 9, which have a stroke corresponding to the distance of advance at each step, the abutment beam 12 becomes prestressed. The feed beam 5, which is in its slightly oblique position, now exerts a component of force on the abutment beam 12 away from the direction of the dip, with the result that the pivot bolts 16,17,18,19 of the guide arms 14,15 are moved, within the bolt clearance, into a position directed upwards or away from the dip. Thus the feed beam 5 is moved upwards by a small amount relative to its normal position, when the beam is in the feed position. To then advance the support, the lowermost roof-support element C is released or robbed and moved forward. During the robbing process, the adjusting cylinder 23 is extended and the abutment beam is pushed away from the feed beam and away from the dip by an amount equal to the length of the slot 13. This amount corresponds to the bolt clearances or play which would otherwise produce mis-alignment when the bottom element C advances. Next, the central support element B is robbed and moved forwards. During this process, the adjusting cylinder 23 is extended, the result being that the abutment beam 12 is pushed upwards by an amount equal to the length of the slot 21. After the central support unit B has settled, the adjusting cylinder 23 is again retracted and the top support element A is robbed and moved forward.

During each of the successive advance movements of the self-advancing support, the abutment beam 12 experiences an impulse of motion against gravity, which counteracts the natural tendency of the support to move out of position and thus guides the support exactly in the preset direction even in steep dips. The slope of the abutment 12 and the beam 5 can easily be adapted to the angle of the working-face.

We claim:

1. A self-advancing mine-roof support assembly for use in longwall mining comprising: three roof-support elements arranged side-by-side but spaced apart a predetermined lateral distance from each other measured at right angles to the direction of advance, a floor runner on each of said elements to permit movement of each element over the floor of a mine, double-acting drive means supported on each runner to move said respective runners, a rigid beam connected to the drive means of the middle one of said roof-support elements and arranged to be generally in alignment with the direction of advance of the assembly, pivot means connecting an end portion of said beam directly to an intermediate portion of an elongate abutment adapted to lie adjacent to and generally parallel to the mine work face, a first side boom connected to the drive means of an outer one of said roof-support elements, a first pair of arms pivotally connecting said side boom to an outer portion of said abutment, a second side boom connected to the drive means of the other outer one of said roof-support elements, a second pair of arms pivotally connecting said second side boom to an opposite outer portion of said abutment, said two pairs of arms being substantially equidistant from said pivot means for said beam and said abutment, whereby slanting of said abutment with respect to the direction of advance of the assembly, which slanting causes said roof-support elements to become staggered relative to each other, causes no change in the "between centres" distance between the roof-support elements.

2. An assembly according to claim 1, in which the rigid beam of the middle one of the three roof-support elements is adjustable to bring the beam generally into alignment with the direction of advance by means of an aligning ram mounted on the floor runner of said middle element.

3. An assembly according to claim 1, in which the drive means driving the beam of the middle element has twice the power of the drive means of either one of the outer elements.

4. An assembly according to claim 1, in which said pivot means connecting the rigid beam to said abutment comprise a pivot pin movable in a slot in said abutment, which slot extends longitudinally of the abutment.

5. An assembly according to claim 1, in which a sliding guide shoe acts between said beam and the floor runner of the middle roof-support element to bring the beam into a position where it extends at a slight angle to the direction of advance.

6. An assembly according to claim 1, in which the drive means of the middle roof-support element have a longer stroke than the stroke of the drive means of the two outer roof-support elements.

7. An assembly according to claim 4, in which said pivot pin is movable along said slot in the abutment by means of a double-acting hydraulic cylinder.

* * * * *